United States Patent [19]

Rundell

[11] Patent Number: 4,826,655

[45] Date of Patent: May 2, 1989

[54] CAST HIGH SILICON HEAT RESISTANT ALLOYS

[75] Inventor: Gene Rundell, Adrian, Mich.

[73] Assignee: Rolled Alloys, Inc. (a Delaware Corporation), Temperance, Mich.

[21] Appl. No.: 125,244

[22] Filed: Nov. 25, 1987

Related U.S. Application Data

[63] Continuation-in-part of Ser. No. 035,356, Apr. 6, 1987, Pat. No. 4,784,705.

[51] Int. Cl.[4] ..... C22C 38/34

[52] U.S. Cl. ..... 420/50; 420/40; 420/55

[58] Field of Search ..... 420/50, 55, 40

[56] References Cited

U.S. PATENT DOCUMENTS

| | | | |
|---|---|---|---|
| 2,534,190 | 12/1950 | Zikmund | 420/112 |
| 2,580,171 | 12/1951 | Hagglund et al. | 420/62 |
| 2,934,430 | 4/1960 | Klaybor et al. | 420/67 |
| 3,138,457 | 6/1964 | Edwards | 420/428 |
| 4,058,416 | 11/1977 | Eiselstein et al. | 420/584 |
| 4,063,935 | 12/1977 | Fujioka et al. | 420/50 |
| 4,077,801 | 3/1978 | Heyer | 420/584 |
| 4,385,933 | 5/1983 | Ehrlich et al. | 420/53 |
| 4,388,125 | 6/1983 | Benn | 420/452 |

FOREIGN PATENT DOCUMENTS

| | | |
|---|---|---|
| 50-1091162 | 8/1975 | Japan . |
| 57-79153 | 5/1982 | Japan . |

OTHER PUBLICATIONS

"Evaluation of Heat Resistant Alloys in Composite Fixtures", G. R. Rundell, NACE, Paper No. 377.

*Primary Examiner*—Deborah Yee

*Attorney, Agent, or Firm*—Webb, Burden, Ziesenheim & Webb

[57] ABSTRACT

A new cast high silicon heat resistant alloy is provided having the broad composition of about 0.16 to 0.30% carbon, about 3.2 to 4.5% silicon, about 0.8 to 1.5% aluminum, about 17 to 20% chromium, about 12 to 16% nickel, up to about 2% manganese, 0 to 0.07% rare earth alloys and the balance iron with residual impurities in ordinary amounts. The alloy is an austenitic chromium and nickel containing alloy having high strength and corrosion resistance.

8 Claims, No Drawings

CAST HIGH SILICON HEAT RESISTANT ALLOYS

This application is a continuation-in-part of my earlier application Serial No. 035,356 filed Apr. 6, 1987 now U.S. Pat. No. 4,784,705.

The present invention relates to cast high silicon heat resistant alloys and particularly to an austenitic chromium and nickel containing alloy having a relatively high silicon and aluminum content with more carbon than can be dissolved in the alloy so that carbide becomes a second phase in the alloy.

The problem of providing heat and corrosion resistance in alloys has been addressed by many metallurgists over the years with a variety of alloys being proposed for the solution of problems presented to their developer. Many of these alloys are chromium nickel containing alloys. Among such alloys are those described in Heyer et al. U.S. Pat. No. 4,077,801, Edwards U.S. Pat. No. 3,138,457, Benn U.S. Pat. No. 4,388,125, Eiselstein et al. U.S. Pat. No. 4,058,416, Ehrlich et al. U.S. Pat. No. 4,385,933, Klaybor et al. U.S. Pat. No. 2,934,430, Hagglund et al. U.S. Pat. No. 2,580,171, Zikmund et al. U.S. Pat. No. 2,534,190 and Fujioka et al. U.S. Pat. No. 4,063,935.

The present alloy is designed to provide not only resistance to heat and oxidization but also to provide high temperature strengthening and austenitic stability as well as castability This provides a relatively low cost alloy in the austenitic state substantially free of ferrite in the cast condition. This is accomplished by alloy additions which go contrary to the prevailing beliefs of the metallurgical industry. For example, the beneficial effects of silicon on resistance to carburization have been recognized for many years. However, it is unusual to add more than 2½% of silicon to an iron-chromium-nickel grade because such additions result in severe embrittlement when these alloys are used below temperatures of 1700° F. I have discovered that by controlling the carbon and chromium content in the present invention this problem of embrittlement can be controlled. In the industry it is believed that silicon alone or silicon plus aluminum will severely limit weldability. In my alloy composition I have found that this is not a problem.

I have discovered that the carbon as called for in my composition provides high temperature strengthening, contributes to austenitic stability, retards undesirably grain coarsening and is essential in preventing embrittlement. The amount of carbon added in the present composition is such that it exceeds the amount that can be dissolved and as a result carbide actually appears as a second phase in the alloy. The carbon content of the alloy is critical and permits the inclusion of higher levels of aluminum and silicon to provide a fully austenitic alloy as cast.

The present invention provides a cast high silicon heat resistant alloy of the austenitic type comprising about 0.16 to 0.30% carbon, about 3.2 to 4.5% silicon, about 0.8 to 1.5% aluminum, about 17 to 20% chromium, about 12 to 16% nickel, up to about 2% manganese, and the balance iron with usual impurities in ordinary amounts. The invention also contemplates the addition of up to about 0.07% of a rare earth metal or metals such as cerium to improve oxidation resistance where necessary. Preferably the alloy of this invention comprises about 0.20% carbon, about 3.5% silicon, about 1% aluminum, about 18.5% chromium, about 14.5% nickel, about 0.6% manganese and the balance iron with residual impurities in ordinary amounts.

While this application is directed to the cast alloy it still has some of the characteristics of the wrought alloy, if worked. It is, however, a cast alloy, if unworked, and is still strong and resistant to carburization alloy.

The alloy of this invention was compared with available commercial materials for various properties, including resistance to pack carburization, resistance to corrosion in sulfurizing atmospheres, isothermal oxidation resistance in still air, cyclic oxidation resistance in still air. While all of this data was derived from wrought alloys the comparison is very close to being the same as the cast alloys and my experience has been generally that the cast alloys are slightly higher in value.

The composition of the alloy of this invention used in these tests was:

| |
|---|
| C - 0.20% |
| Si - 3.64% |
| Al - 1.04% |
| Cr - 18.36% |
| Ni - 14.36% |
| Mn - 0.57% |
| Fe - Balance with Residuals of: |
| N - 0.01% |
| P - 0.019% |
| S - 0.001% |
| Mo - 0.25% |
| Cu - 0.34% |
| Co - 0.05% |

The test results appear in the following tables:

TABLE I

LABORATORY PACK CARBURIZING TEST IN PULVERIZED COAL (1950° F. - 30 Days)

| Alloy Designation | % Tensile Ductility After Carburization |
|---|---|
| 601 | 15% |
| Alloy of invention | 11% |
| Cabot 214 | 4.0% |
| RA333 | 1.5% |
| RA 253 MA | 0.5% |
| T302 B | Nil |

These tests show that the alloy of this invention has superior carburization resistance. The criteria used for evaluation is tensile ductility after exposure to carburizing conditions. The alloy of this invention is superior to every alloy except alloy 601 which is an expensive nickel-base alloy.

The compositions of the prior art alloys used in this test are:

| | C | Si | Mn | Ni | Cr | N | Al | Ti | Fe |
|---|---|---|---|---|---|---|---|---|---|
| 601 | .049 | .22 | .18 | 61.9 | 22.4 | — | 1.31 | .42 | 13.5 |
| Cabot 214 (nominal) | .04 | — | — | Bal | 16 | — | 4.5 | — | 2.5 |
| | | | | | | | | | Y Present |
| RA 333 | .032 | 1.20 | 1.32 | 47.1 | 25.1 | — | — | — | Bal W-2.7 Mo-2.8 Co-2.9 |

-continued

| | C | Si | Mn | Ni | Cr | N | Al | Ti | Fe |
|---|---|---|---|---|---|---|---|---|---|
| RA253MA | .088 | 1.73 | .70 | 10.9 | 21.2 | .17 | — | — | Bal Ce-.03 |
| T302B | .076 | 2.25 | 1.77 | 9.8 | 17.4 | — | — | — | Bal |

TABLE II

RESISTANCE TO CORROSION IN SULFURIZING ATMOSPHERE (Corrosion Rate at 1000° F. in 4½ months)

| Alloy | Corrosion, mils |
|---|---|
| RA 446 | 1.3 |
| Alloy of invention | 1.6 |
| 309 | 2.0 |
| RA 253 | 3.8 |
| 601 | 5.5 |
| 310 | 5.9 |
| 330 | 6.9 |
| 333 | 8.8 |

Here the ferritic high chromium alloy 446 containing no nickel is the only alloy superior to the alloy of the invention. Of the austenitic alloys, the alloy of the present invention is far superior in corrosion in sulfurizing atmosphere.

The compositions of the prior art alloys used in this test are:

| | C | Si | Mn | Ni | Cr | N | Ti | Al | Fe | Other |
|---|---|---|---|---|---|---|---|---|---|---|
| RA446 | .06 | .37 | .72 | .29 | 26.2 | .09 | — | — | Bal | |
| 309 | .06 | .28 | 1.59 | 13.06 | 22.50 | — | — | — | Bal | |
| RA253 | .083 | 1.74 | .50 | 11.0 | 20.9 | .17 | — | — | Bal | Ce .05 |
| 601 | | | | | Not Available | | | | | |
| 310 | .048 | .52 | 1.29 | 20.07 | 24.33 | .03 | — | — | Bal | |
| 330 | .057 | 1.12 | 1.61 | 34.81 | 19.20 | .01 | — | — | Bal | |
| 333 | .054 | 1.45 | 1.26 | 45.80 | 25.00 | — | — | — | Bal | W 2.80<br>Mo 2.70<br>Co 2.95 |

TABLE III

OXIDATION RESISTANCE (Isothermal Exposure in Still Air)

| Alloy | Metal Loss After 3,000 hrs. in mils 2100° F. | 2200° F. |
|---|---|---|
| Alloy of Invention | 2.79 | 4.77 |
| RA 310 | 2.15 | 3.47 |
| RA 253 | 3.14 | 82.00 |
| RA 330 | 2.77 | 4.42 |

The alloy of the invention is similar in resistance to more costly materials such as RA 330 and far superior to RA 253 which has similar levels of chromium and nickel and is thus similar in cost.

TABLE IV

OXIDATION RESISTANCE (Cyclic Exposure at 2100° F. in Still Air)

| Alloys | Metal Loss After 500 hrs in mils |
|---|---|
| Alloy of Invention | 11.5 |

TABLE IV-continued

OXIDATION RESISTANCE (Cyclic Exposure at 2100° F. in Still Air)

| Alloys | Metal Loss After 500 hrs in mils |
|---|---|
| RA 330 | 9.1 |
| RA 253 | 10.5 |
| RA 310 | 7.1 |
| 800 | 18.0 |

The alloy is similar to the more costly RA 330 and much superior to the high nickel-chromium alloy 800.

The compositions of the prior art alloys used in the two tests are:

| | C | Si | Mn | Ni | Cr | N | Ti | Al | Fe | Other |
|---|---|---|---|---|---|---|---|---|---|---|
| RA310 | .069 | .75 | 1.53 | 19.41 | 24.45 | — | — | — | Bal | — |
| RA253 | .086 | 1.45 | .73 | 10.8 | 20.7 | .184 | — | — | Bal | Ce .05 |
| RA330 | .061 | 1.30 | 1.46 | 34.99 | 18.15 | — | — | — | Bal | W .18 |
| 800 | .08 | .30 | .94 | 30.76 | 20.78 | — | .44 | .42 | 45.76 | Cu .52 |

TABLE V

LABORATORY PACK CARBURIZING IN ACTIVATED COKE (1800° F. - 360 h)

Amount of Carbon Absorbed At Indicated

| Alloy | Depth From Surface in % 0.00 to 0.02 in | 0.02 to 0.04 in | 0.04 to 0.06 in | 0.06 to 0.08 in | 0.08 to 0.10 in | 0.10 to 0.12 in |
|---|---|---|---|---|---|---|
| Alloy of invention | 0.44 | 0.38 | 0.29 | 0.27 | 0.14 | 0.07 |
| RA 330 | 1.03 | 0.77 | 0.75 | 0.43 | 0.21 | 0.14 |
| RA 253 MA | 1.08 | 1.01 | 0.80 | 0.73 | 0.53 | 0.38 |

The composition of the prior art alloys used in this test are:

| | C | Si | Mn | Ni | Cr | N | Fe |
|---|---|---|---|---|---|---|---|
| RA 253 | .086 | 1.45 | .73 | 10.8 | 20.7 | .184 | Bal |
| RA 330 | .061 | 1.30 | 1.46 | 34.99 | 18.15 | — | Bal |

Here the alloy of the invention is far superior to much more highly alloyed and costly materials in resistance to carburization.

In the foregoing specification certain preferred embodiments and practices of this invention have been set out, however, it will be understood that this invention may be otherwise embodied within the scope of the following claims.

I claim:

1. A cast high silicon heat resistant alloy comprising about 0.16 to 0.30% carbon, about 3.2 to 4.5% silicon, about 0.8 to 1.5% aluminum, about 17 to 20% chromium, about 12 to 16% nickel, up to about 2% manganese, 0 to about 0.07% rare earth metals and the balance iron with residual impurities in ordinary amounts, said alloy being weldable and having a fully austenitic structure in an as cast condition.

2. The alloy as claimed in claim 1 comprising about 0.16 to 0.30% carbon, about 3.2 to 4.5% silicon, about 0.8 to 1.5% aluminum, about 17 to 20% chromium, about 12 to 16% nickel, up to about 2% manganese and the balance iron with usual impurities in ordinary amounts.

3. The alloy as claimed in claim 1 comprising about 0.2% carbon, about 3.5% silicon, about 1% aluminum, about 18.5% chromium, about 14.5% nickel, about 0.6% manganese and the balance iron with residual impurities in ordinary amounts.

4. The alloy as claimed in claim 2 having about 0.02% to 0.07% rare earth metals.

5. The alloy as claimed in claim 4 wherein the rare earth metal is cerium.

6. The alloy as claimed in claim 3 having about 0.05% rare earth metals.

7. The alloy as claimed in claim 4 wherein the rare earth metal is cerium.

8. A high strength corrosion resistant cast article comprising about 0.16 to 0.30% carbon, about 3.2 to 4.5% silicon, about 0.8 to 1.5% aluminum, about 17 to 20% chromium, about 12 to 16% nickel, up to about 2% manganese, 0 to about 0.7% rare earth metals and the balance iron with residual impurities in ordinary amounts, said article being weldable and having a fully austenitic structure in an as cast condition.

* * * * *